US005803827A

United States Patent [19]

Kuykendall

[11] Patent Number: 5,803,827

[45] Date of Patent: Sep. 8, 1998

[54] GOLF CLUBHEAD AND ITS METHOD OF USE

[75] Inventor: Jack Kuykendall, Hoffman Estates, Ill.

[73] Assignee: Natural Golf Corporation, Hoffman Estates, Ill.

[21] Appl. No.: 374,249

[22] Filed: Jan. 18, 1995

[51] Int. Cl.[6] ..... A63B 53/04

[52] U.S. Cl. ..... 473/300; 473/409; 473/349; 473/350

[58] Field of Search ..... 473/300, 301, 473/302, 303, 203, 204, 324, 334, 349, 350, 291, 409

[56] References Cited

U.S. PATENT DOCUMENTS

| | | | |
|---|---|---|---|
| 1,012,299 | 12/1911 | True | 473/300 |
| 1,642,462 | 9/1927 | Reach | 473/290 |
| 2,088,008 | 7/1937 | Link | 473/203 |
| 3,606,326 | 9/1971 | Sparks | 473/300 |
| 3,614,101 | 10/1971 | Hunter | 473/301 |
| 3,751,035 | 8/1973 | Lockwood | 473/290 |
| 5,014,993 | 5/1991 | Antonious | 473/350 |
| 5,547,189 | 8/1996 | Billings | 473/316 |
| 5,562,551 | 10/1996 | Rife | 473/350 |

FOREIGN PATENT DOCUMENTS

| | | | |
|---|---|---|---|
| 2251556 | 7/1992 | United Kingdom | 273/167 R |

*Primary Examiner*—Sebastiano Passaniti
*Attorney, Agent, or Firm*—Oldham & Oldham Co., LPA

[57] ABSTRACT

The present invention relates to an improved golf clubhead and an improved method of swinging the golf club. The improvements afford greater clubhead speed and produce an ideal mechanical advantage golf stroke. The improvements further provide for the minimum clubhead twisting and greater transfer of momentum to the ball.

4 Claims, 10 Drawing Sheets

GOLF CLUBHEAD AND ITS METHOD OF USE

BACKGROUND OF THE INVENTION

A number of studies have been made and theories advanced concerning the principles involved in clubhead twisting from ball impact. This twisting from ball impact has a direct relationship to the flight the ball will have when the ball separates from the clubface. There are numerous clubhead designs to compensate for the various clubhead path and clubface orientation during the impact and separation of the ball from the clubface. Most current designs provide twisting to compensate for non ideal mechanical motions made by golfers. Weight is distributed in various fashions around the perimeter and across the back of the clubhead to provide for the desired twisting effect from ball impact. The predominant design is heel-toe weighting to correct for a ball flight from left to right (commonly labeled a "slice"). The slice is the number one swing fault of the majority of golfers. Recent patents issued to Foxbat for oval or circular distribution, to MacGregor for a larger head and greater heel-toe weighting, and to The Pro Group for an even larger head with a protrusion on the hosel to extend heel-toe weighting even more, are examples of clubheads designed to offer a high moment of inertia in order to compensate for a slice stroke. All the forgoing has been done because it is recognized that teaching a correct swing has had an extremely low success rate. It has become simpler to design clubs to correct for a slice, than to change the swing mechanics.

While the applicant recognizes that training of golfers for an Ideal Mechanical Advantage stroke is difficult, current designs demand that faulty swing mechanics be used. This invention is to design a clubhead that allows the minimum twisting possible from ball impact when used with an Ideal Mechanical Advantage stroke method. This will allow players to improve the accuracy of their shots by developing optimum swing mechanics. Optimum swing mechanics will be illustrated by a comparison with traditional golf instructions. It will be shown that the teachings of the golf stroke in published literature and on other media such as video are not scientific reality but perceptions of the teacher.

SUMMARY OF THE INVENTION

The present invention relates to an improved golf clubhead design and an improved method to swing the golf club which allows for greater clubhead speed and greater accuracy producing an Ideal Mechanical Advantage (maximum force to least effort) golf stroke. The design provides for the minimum of clubhead twisting from ball impact by designing the clubhead to a specific size and with a specific distribution of weight. The design further provides for a greater transfer of the momentum of the clubhead into the ball, which translates to greater initial ball velocity off the clubface, from the optimum placement of the center-of-gravity. The clubhead design allows for a single axis between the dominant arm and clubshaft. A single axis is the only method for producing an Ideal Mechanical Advantage golf stroke.

DESCRIPTION OF THE PREFERRED EMBODIMENT

Figure 1:
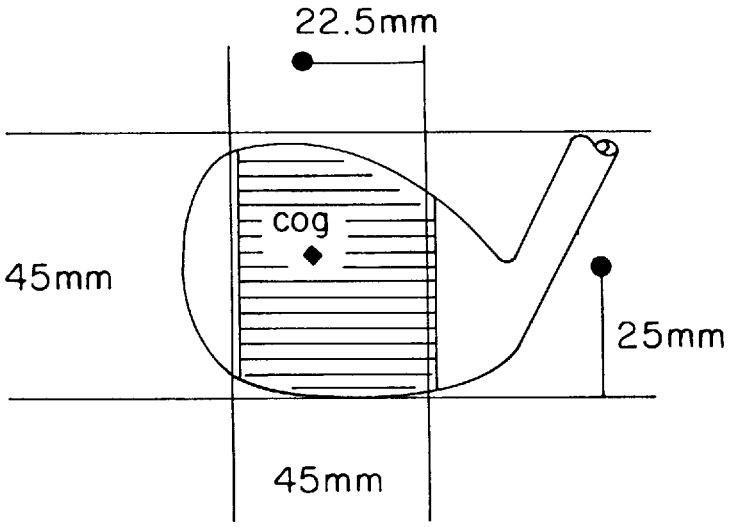
FIG. 1 is a front elevation view.

Refer now to FIG. 1. FIG. 1 illustrates the physics equation of T=R×F (T=torque, R=radius arm, F=force) Torque is equal to the radius arm times the force applied. To reduce torque to a minimum, the radius must be as short as possible. A golf ball is 42.7 millimeters in diameter. When compressed on a clubface the tracing left by a ball covers approximately 20 millimeters. It is necessary to cover the ball tracing on each side of the center of gravity. Therefore the grooved area of the clubface is to made exactly 45 millimeters wide and 45 millimeters high.

Referring again to FIG. 1, the center of gravity is placed exactly 25 millimeters above the sole and exactly in the center of the clubface. This places the center of gravity above ball impact. When a golf ball strikes a golf club head below or on the center of gravity, the force from the impact moves the clubface backwards and a glancing blow is produced. This reduces the speed of the ball off the clubface. When the center of gravity is above ball impact, the backwards motion from ball impact is eliminated and the ball leaves the clubface with maximum velocity.

Referring again to FIG. 1, the hosel is exactly in line with the top of the clubhead. This allows for "absolutely" even weight distribution from the top of hosel, down the hosel, around the bottom of the sole, and up to top of the toe of the head. There is "absolutely" no heel-toe weighting or uneven distributions or flow weighting. This configuration of even weight distribution and shortest radius arm from the center of gravity allows for the same moment of inertia on the grooved area of the clubface and virtually eliminates clubhead twisting from ball impact.

Figure 2:
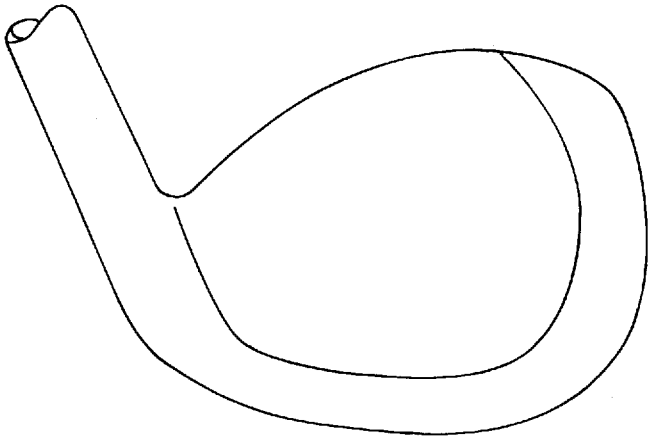
FIG. 2 is a rear elevational view.
Figure 3A:
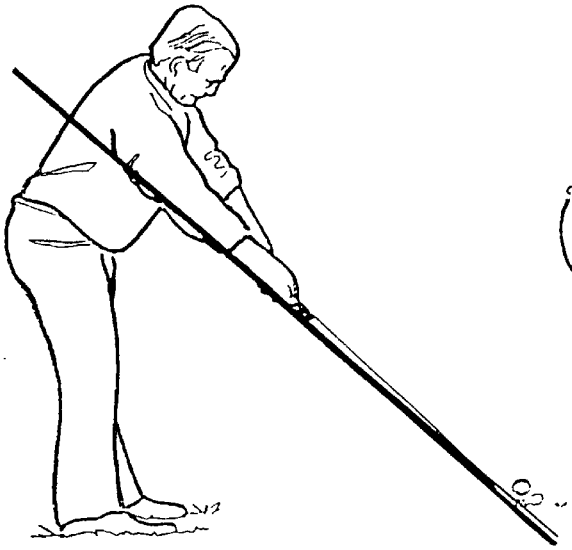
FIG. 3 is a view of golfers address position from the front and side
Figure 3B:
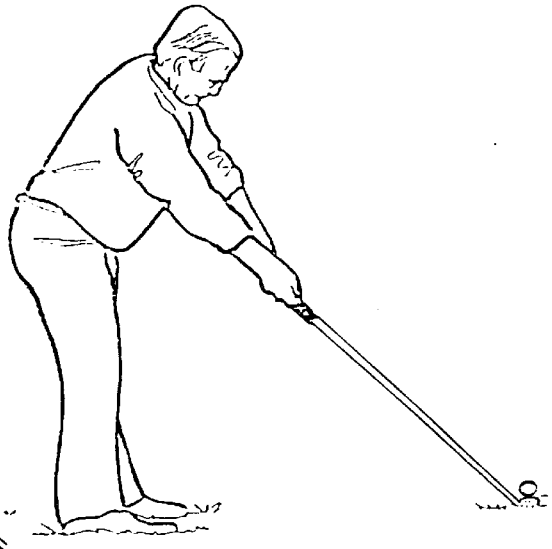
Figure 3C:
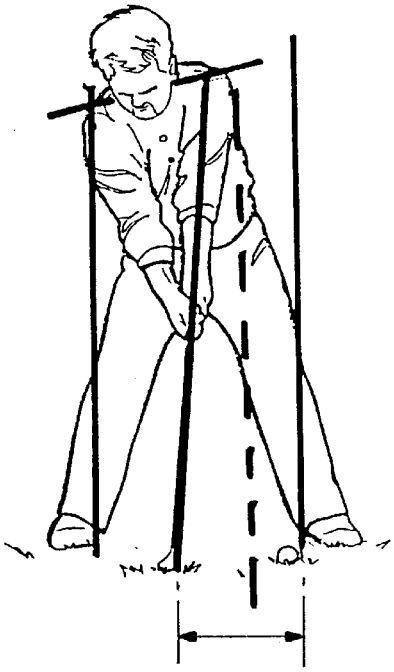
Figure 3D:
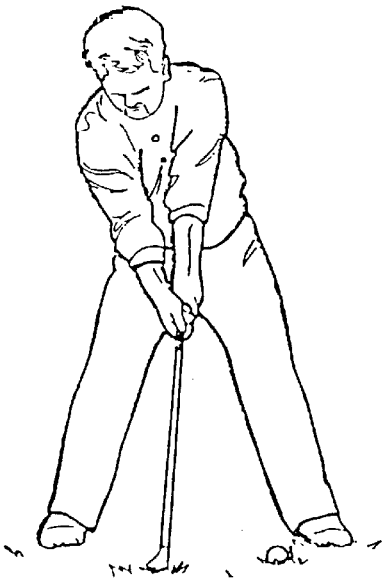
Figure 4A:
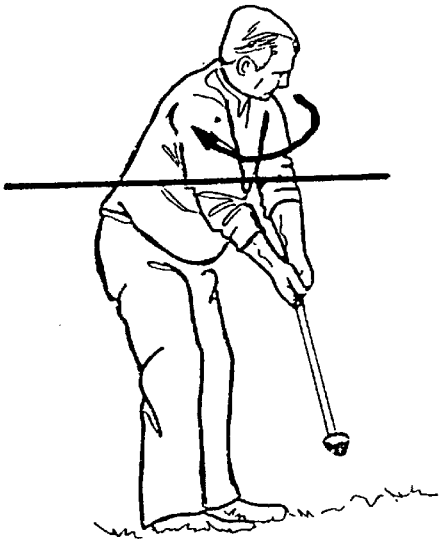
FIG. 4 is a view of golfers second position in the backstroke
Figure 4B:
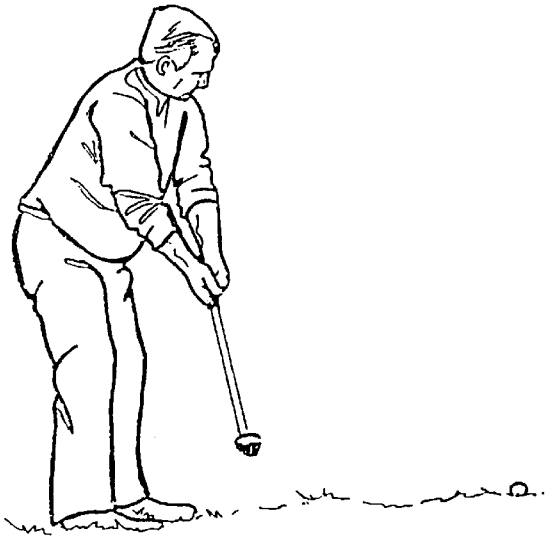
Figure 4C:
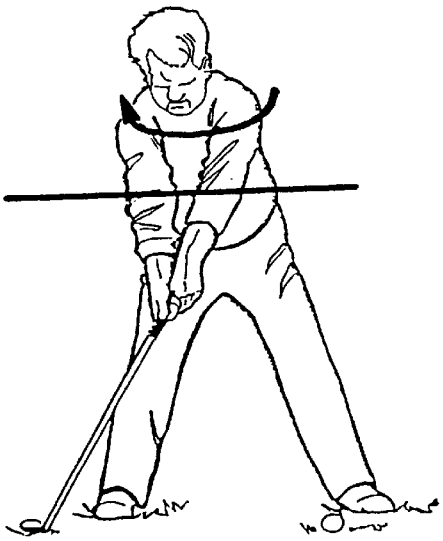
Figure 4D:
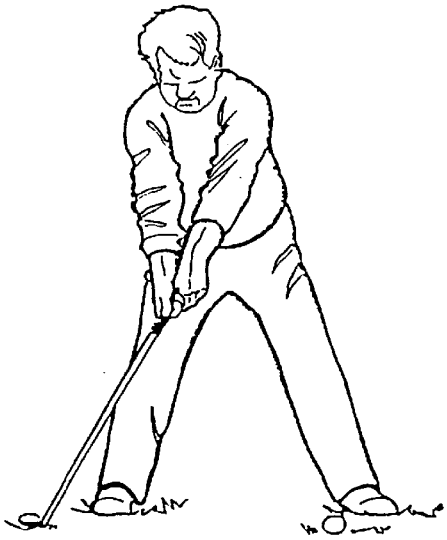
Figure 5A:
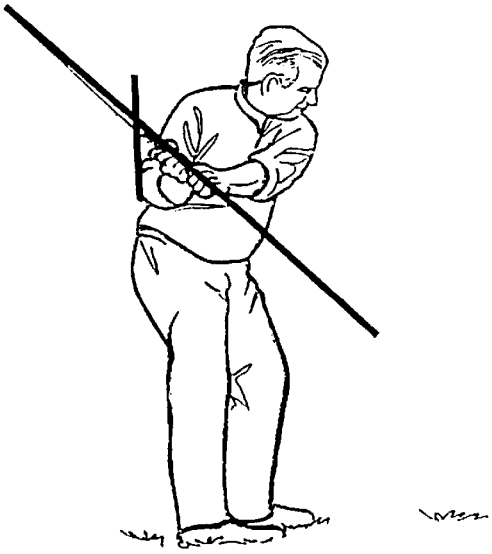
FIG. 5 is a view of golfers third position in the backstroke
Figure 5B:
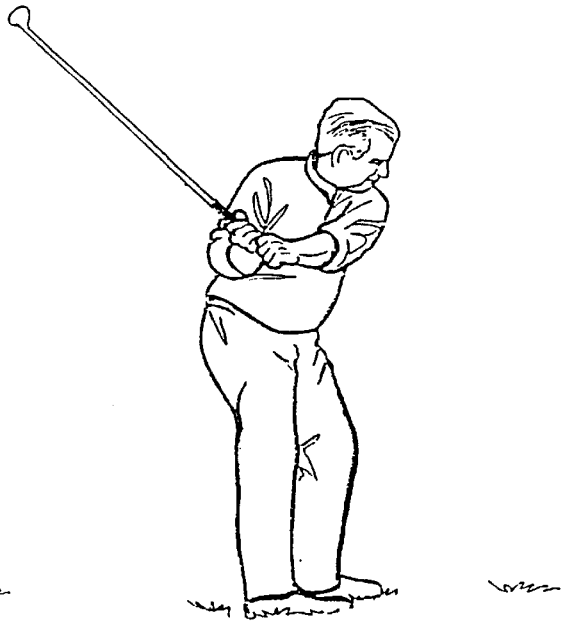
Figure 5C:
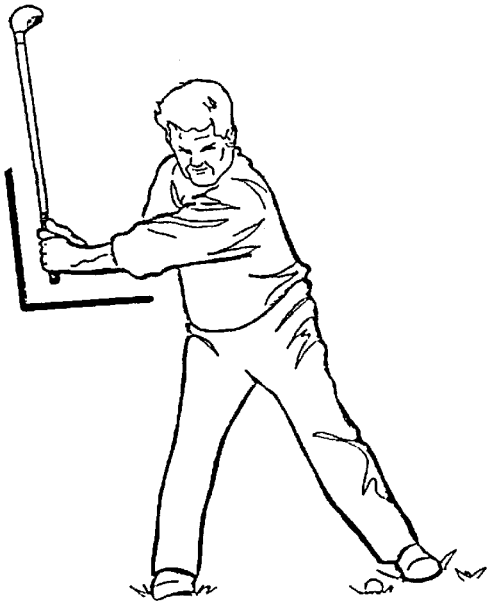
Figure 5D:
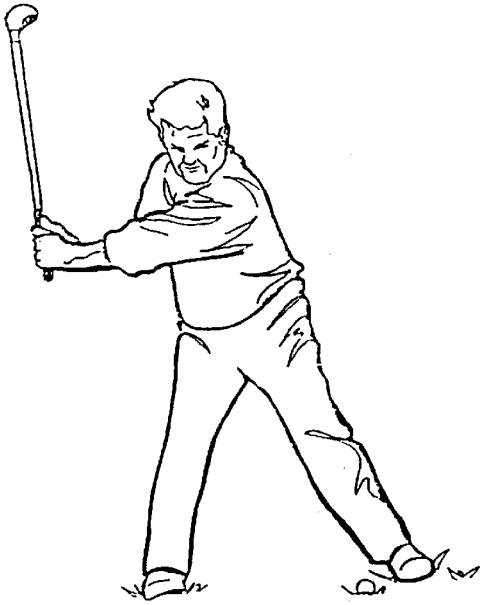
Figure 6A:
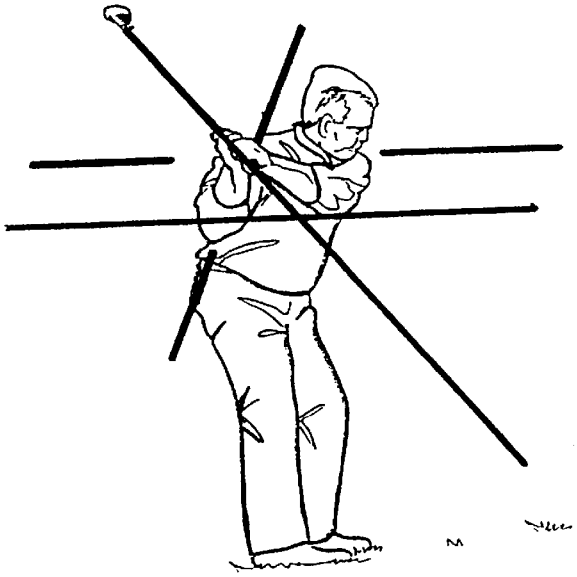
FIG. 6 is a view of golfers forth position at the top of the backstroke
Figure 6B:
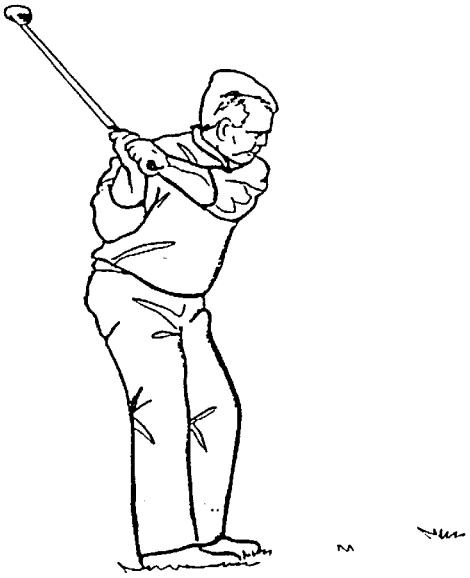
Figure 6C:
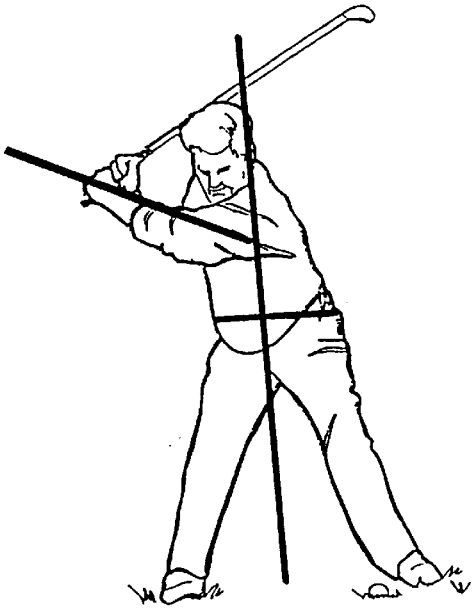
Figure 6D:
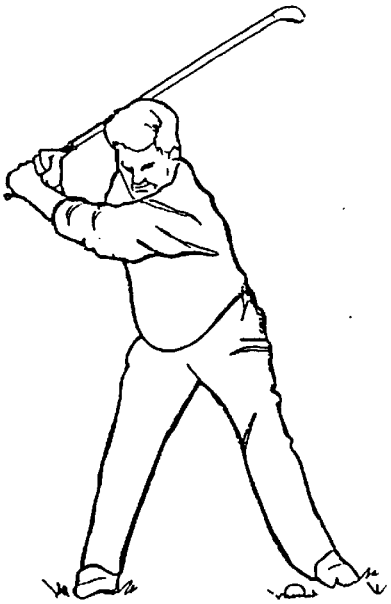

Refer now to FIG. 2. All the weight, except for the grooved area of the clubface, is placed with "absolutely" even weight distribution from the top of the hosel, down the hosel, around the sole and up to the top of the toe of the clubhead. Again, this provides for the elimination of clubhead twisting from ball impact.

A study performed by Golf Digest showed what happens when you hit heel-toe weighted and classic weight distribution in a clubhead. Heel-toe weighted had a range of 80 yards of deviation and the classics had approximately a 40 yard deviation.

An advertisement by MacGregor Golf shows the dispersion of heel-toe weighted clubs from clubhead twisting from ball impact.

A paper was distributed by Wilson Golf comparing several heel-toe weight clubs. It again verifies that there is substantial clubhead twisting from ball impact with heel-toe weighted clubheads.

Figure 12:
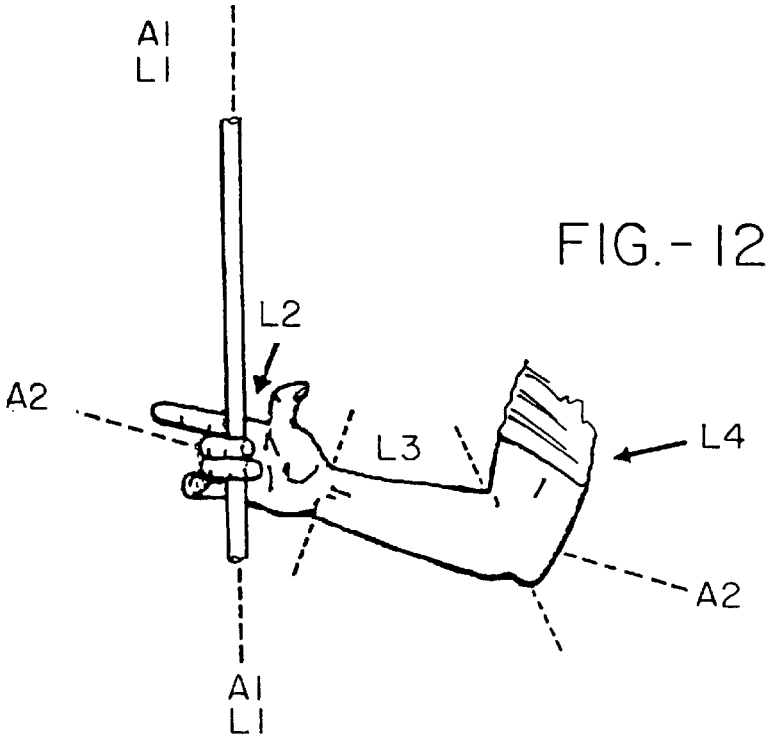
FIG. 12 is a view of a traditional grip
Figure 13:
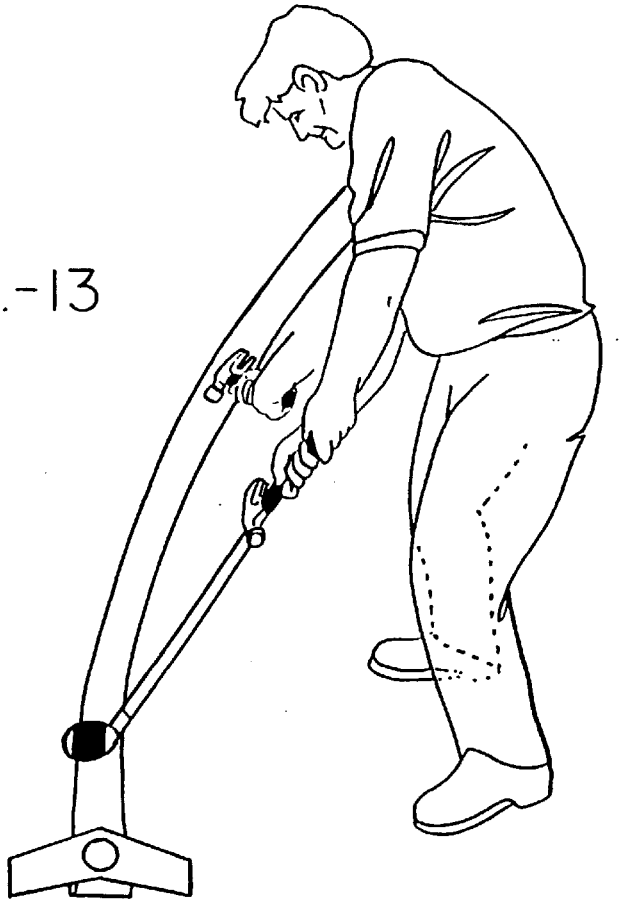
FIG. 13 is a view of the perceptions of current teachers concerning spine angle

Refer now to FIG. 12. This is a view of the dominant hand finger grip taught in every golf instruction medium in existence. When the grip is taken in the fingers of the dominant hand, major mechanical disadvantages occur. It creates a two axis, four lever system in the dominant arm. The shaft of the club forms one axis and the right arm forms a second axis. The shaft of the club is a lever, the palm of the dominant hand is a lever, the dominant forearm is a lever, and the upper arm is lever.

Current teachers and players perceive that the spine angle remains the same throughout the swing. This is a perception and not scientific reality.

An article published by Golf Digest, written by Dr. Ralph Mann verifies that no one swings a golf club on a single plane.

In a traditional swing, the shoulders will rotate on one plane, the arm will rotate on a second plane, the hands will rotate inside the arm plane, the clubhead will rotate on a forth plane, and the clubface will be rotating on a fifth plane inside the clubhead plane, and the spine angle will be moving upward and backward. This is about as far from an Ideal Mechanical Advantage golf swing as it's possible to get to try and consistently hit a golf ball where you want it to go.

Refer now to FIG. 11. This current invention allows the grip of the shaft to be placed across the lifeline of the dominant hand. The golf club effectively becomes a hammer. When the grip is placed in the lifeline of the dominant hand, it creates a single axis, three lever system in the dominant arm. This allow for straight line hammer motions (an Ideal Mechanical Advantage stroke).

When the grip is placed in the lifeline of the dominant hand and swung back and forth, it can be swung on a single plane. This allows for increased clubhead speed and increased reproducibility of the motion for hitting a golf ball where you want it to go.

When a clubhead produces virtually no twisting from ball impact and is designed with an angle between the ground and shaft that allows for no adjustment of the dominant arm to form a single axis of the dominant arm and clubshaft when gripped in the lifeline of the dominant hand, consistent reproduction on a single plane is produced. The right hand, right shoulder and the clubhead remain on a single plane from the top of the backstroke to ball impact. This allows for Ideal Mechanical Advantage stroke. Maximum ratio of maximum force for the least effort.

Refer now to FIG. 3. This is a view of golfers position from the front and the rear. For an Ideal Mechanical Advantage stroke, there must be a straight line from the clubhead, through the shaft, through the grip, through the lifeline of the dominant hand, through the dominant forearm, and through the upper arm to the dominant shoulder. Only a single axis dominant arm system can be swung on a single plane.

Refer now to FIG. 4. This is a view of a golfers second position. The shoulders and body rotate laterally into the median plane.

Refer now to FIG. 5. This is a view of a golfers third position. The biceps curl the dominant arm and rear forearm muscles extends the dominant hand and clubhead to form a 90 degree angle between the dominant forearm and the clubshaft.

Refer now to FIG. 6. This is a view of a golfers fourth position. The top of the stroke is when the right wrist reached shoulder height.

Figure 7A:
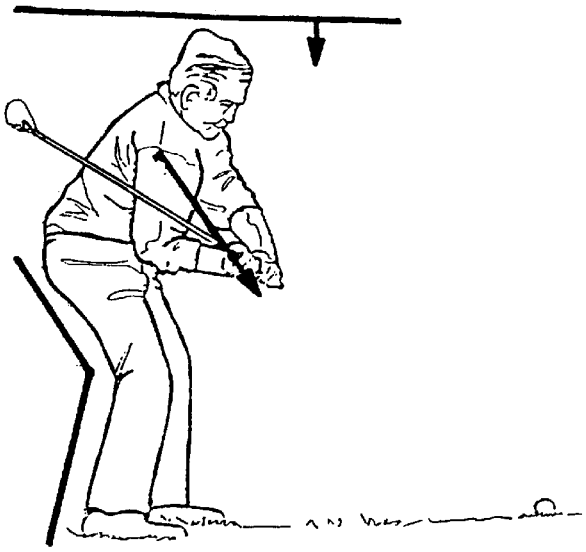
FIG. 7 is a view of golfers fifth position at the start of the downstroke
Figure 7B:
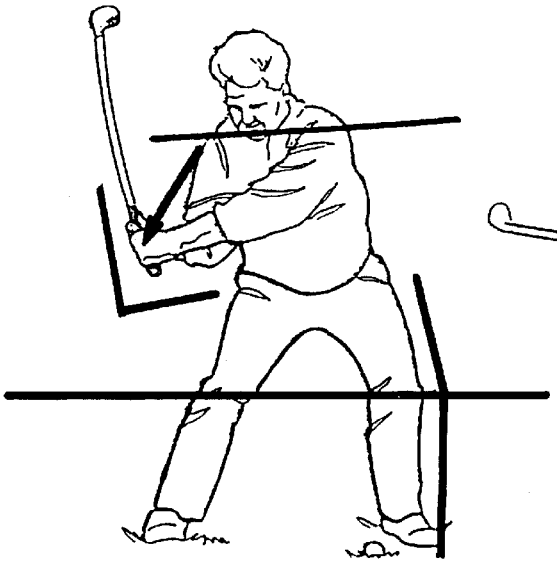
Figure 7C:
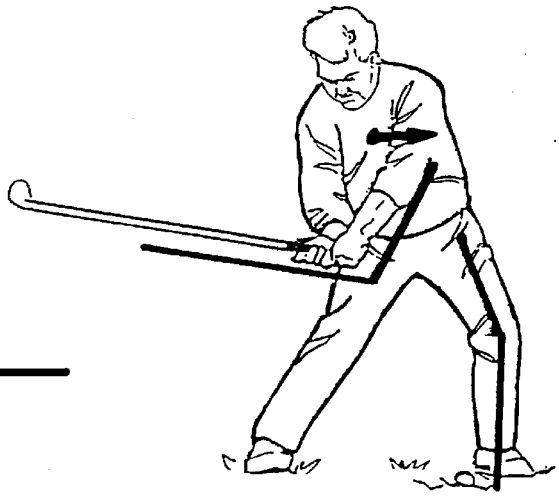

Refer now to FIG. 7. This is a view of a golfers fifth position. The first motion is to lower body center approximately 2 to 3 inches by flexing the knees. The mass is moving in the direction of the force. In a traditional golf stroke, because of the two axis formed between the shaft and the arms, the mass moves upward and backward—the mass moves in the opposite direction of the force.

Figure 8A:
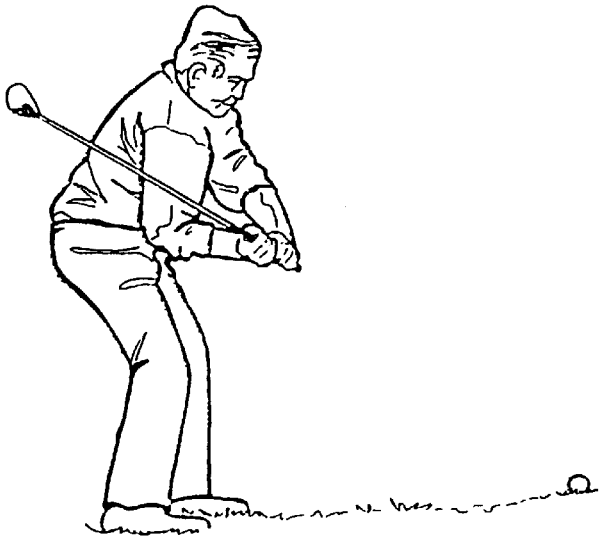
FIG. 8 is a view of golfers sixth position, shaft parallel to the ground
Figure 8B:
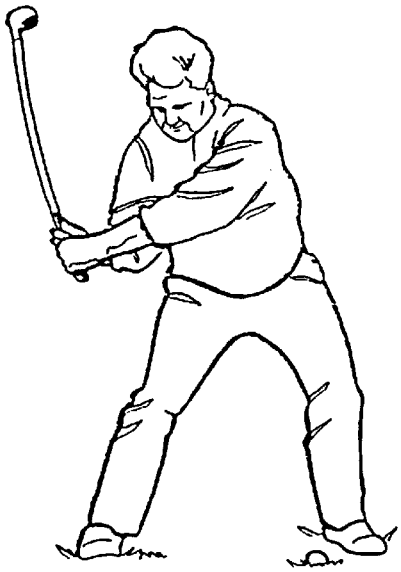
Figure 8C:
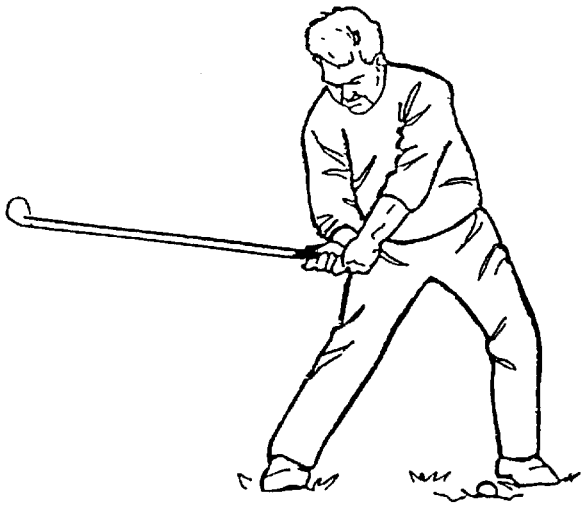
Figure 9A:
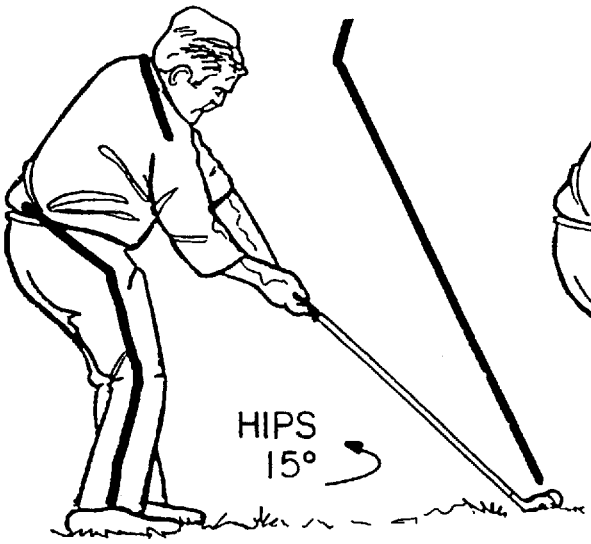
FIG. 9 is a view of golfers seventh position, impact
Figure 9B:
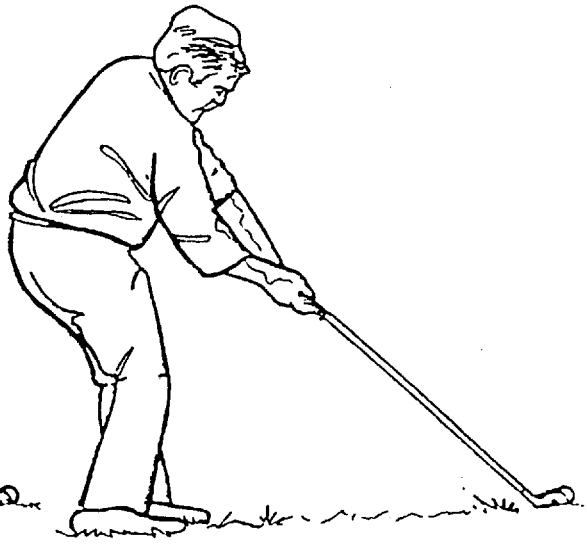
Figure 9C:
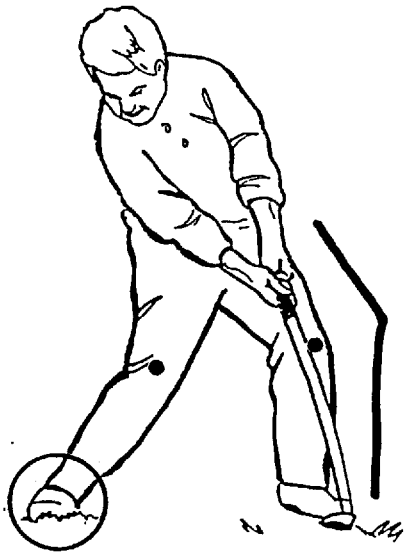
Figure 9D:
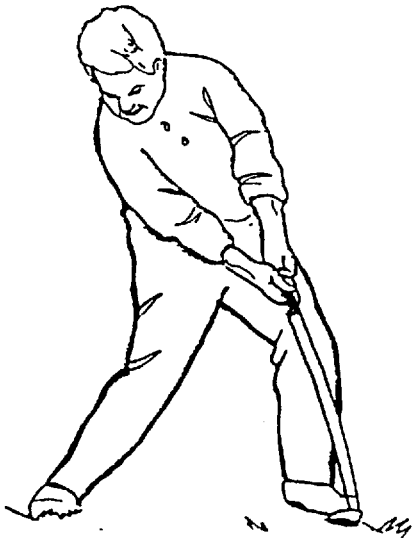
Figure 11A:
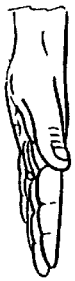
FIG. 11 is a view of an Ideal Mechanical Advantage grip
Figure 11B:
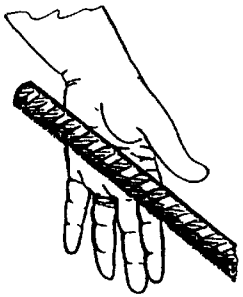
Figure 11C:
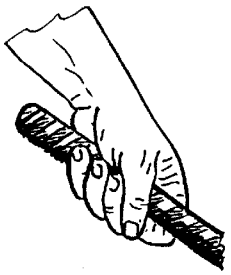
Figure 11D:
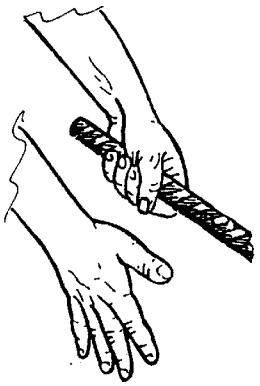
Figure 11E:
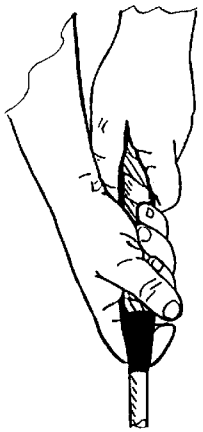
Figure 10A:
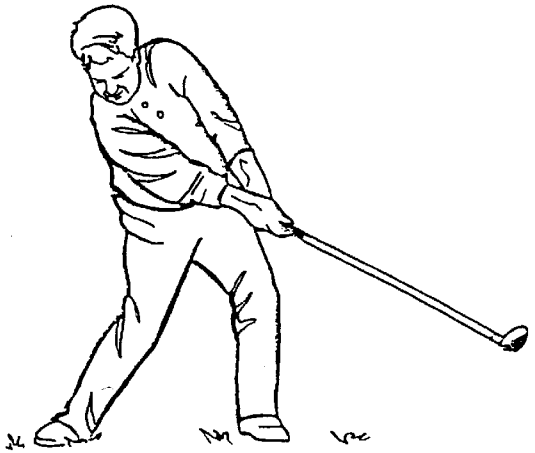
FIG. 10 is a view of golfers eighth position, just past impact
Figure 10B:
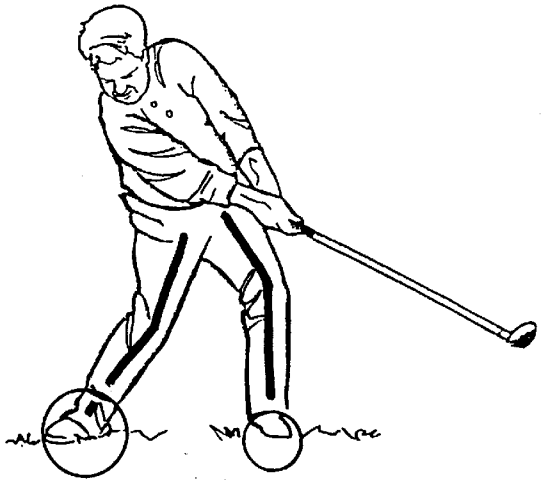

Refer now to FIG. 8. This must be the exact sequence of motions to perform an Ideal Mechanical Advantage motion. The right hand moves in a straight line toward the intended line of flight. The right hand, the right shoulder and the clubhead will form a straight line from the top of the stroke until ball impact. Only a single axis system with the grip in the lifeline of the dominant palm can perform this motion. A traditional two axis system cannot have the dominant shoulder, the dominant palm and the clubhead on the same plane from the top of the stroke to impact. It is impossible to rotate a two axis system on the same plane.

Referring again to FIG. 8. The non-dominant knee is flexed approximately 2 to 3 inches and moves directly towards the non-dominant big toe. The angle between the dominant forearm and the dominant hand has been retained.

Refer now to FIG. 9. At impact of the clubhead with the ball, the dominant knee will be below the non-dominant knee. Both knees will be flexed. The hips will be parallel to 15 degrees of rotation away from the intended line of ball flight. The shoulders will be parallel to the intended line of flight. The dominant elbow will be closer to the body than the non-dominant elbow and dominant arm will be slightly flexed. The back of the non-dominant hand will perpendicular to the intended line of flight and the palm of the dominant hand will perpendicular to the intended line of flight.

I claim:

1. A golf club having an elongate shaft, a grip and a clubhead including a heel, toe and sole with a hosel connecting said clubhead to said shaft, wherein:

a) said clubhead has a striking surface, said striking surface having a grooved area thereon, said grooved area being at least 45 millimeters in height and at least 45 millimeters in width, said striking surface further having a center of gravity at least 25 millimeters above said clubhead sole and equidistant from said heel and said toe;

b) said clubhead has its weight distributed evenly around a specified portion of the clubhead, said specified portion starting at the hosel and proceeding down and around said hosel, along the sole to the top of the toe; and c) said clubhead has a lie angle between 60 and 65 degrees.

2. A method for striking a golf ball by a golfer with a dominant arm and a dominant hand, the dominant hand having a lifeline thereon, comprising the steps of:

a) placing a golf club along the lifeline of the dominant hand so as to create a single-axis, three-lever system between the dominant arm and the club, said golf club having an elongate shaft, a grip and a clubhead including a heel, toe and sole with a hosel connecting said clubhead to said shaft, wherein:

said clubhead has a striking surface, said striking surface having a grooved area thereon, said grooved area being 45 millimeters in height and 45 millimeters in width, said striking surface further having a center of gravity at least 25 millimeters above said clubhead sole and equidistant from said heel and said toe;

said clubhead has a lie angle between 60 and 65 degrees, and b) said golfer performing, subsequent to the step a), a golf swing maintaining said single-axis, three-lever system.

3. A golf club as claimed in claim 1, wherein said grip has a diameter of at least 0.9 inch.

4. A method for striking a golf ball as claimed in claim 2 wherein said grip has a diameter of at least 0.9 inch.

* * * * *